US009010746B2

(12) United States Patent
Zhao et al.

(10) Patent No.: US 9,010,746 B2
(45) Date of Patent: Apr. 21, 2015

(54) SHEET MEDIUM PROCESSING DEVICE

(75) Inventors: Zhenxing Zhao, Shandong (CN); Zhigang Xu, Shandong (CN); Ming Gao, Shandong (CN); Qingbang Xu, Shandong (CN)

(73) Assignee: Shandong New Beiyang Information Technology Co., Ltd., Shandong (CN)

( * ) Notice: Subject to any disclaimer, the term of this patent is extended or adjusted under 35 U.S.C. 154(b) by 0 days.

(21) Appl. No.: 13/979,130

(22) PCT Filed: Jan. 11, 2012

(86) PCT No.: PCT/CN2012/070217
§ 371 (c)(1),
(2), (4) Date: Sep. 3, 2013

(87) PCT Pub. No.: WO2012/094999
PCT Pub. Date: Jul. 19, 2012

(65) Prior Publication Data

US 2013/0334767 A1 Dec. 19, 2013

(30) Foreign Application Priority Data

Jan. 11, 2011 (CN) ..... 2011 1 0004944

(51) Int. Cl.
*B65H 29/14* (2006.01)
*B65H 29/00* (2006.01)
(Continued)

(52) U.S. Cl.
CPC ..... *B65H 29/00* (2013.01); *B65H 29/145* (2013.01); *B65H 11/007* (2013.01); *B65H 5/023* (2013.01);
(Continued)

(58) Field of Classification Search
CPC ..... B65H 5/023; B65H 11/007; B65H 29/12; B65H 29/14; B65H 29/145; B65H 2404/2614; B65H 2404/2615
USPC ..... 271/3.01–3.03, 3.14, 198, 272–274; 198/626.3, 626.5; 414/788.8, 794.4, 414/797.6
See application file for complete search history.

(56) References Cited

U.S. PATENT DOCUMENTS 4,462,509 A * 7/1984 Adelberger ..... 221/259
4,903,457 A 2/1990 Dimur
(Continued)

FOREIGN PATENT DOCUMENTS

CN 1139911 A 1/1997
CN 1155873 A 7/1997
(Continued)

OTHER PUBLICATIONS

International Search Report of the SIPO in application No. PCT/CN2012/070217 dated Mar. 20, 2012.
(Continued)

*Primary Examiner* — Ernesto Suarez
(74) *Attorney, Agent, or Firm* — Kinney & Lange, P.A.

(57) ABSTRACT

A sheet medium processing device comprising a stacking mechanism mounted on a frame, a first switching mechanism and a retractable paper baffle adjacent to the medium exit of the stacking mechanism; the stacking mechanism comprises a lower ticket stacking assembly, an upper ticket stacking assembly capable of moving parallelly above the lower ticket stacking assembly and a parallel movement confining mechanism, wherein the upper ticket stacking assembly and the lower ticket stacking assembly are both belt-conveyor mechanisms, and the belt of the upper ticket stacking assembly has a tendency of tightly pressing against the belt of the lower ticket stacking assembly. The first switching mechanism simultaneously controls the reciprocation of the paper baffle and the parallel movement of the upper ticket stacking assembly, enabling the stacking mechanism to be selectively provided with a transport state and a stacking state. The sheet medium processing device utilizes the elasticity of the belts of the stacking mechanism to adjust and limit the vertical-direction state of multiple stacked sheet mediums, thereby achieving reliable transportation.

11 Claims, 13 Drawing Sheets

(51) Int. Cl.

| | |
|---|---|
| ***B65H 29/12*** | (2006.01) |
| ***B65H 31/30*** | (2006.01) |
| ***B65H 29/58*** | (2006.01) |
| *B65H 11/00* | (2006.01) |
| *B65H 5/02* | (2006.01) |
| *G07B 1/00* | (2006.01) |

(52) U.S. Cl.

CPC ..... *B65H 29/12* (2013.01); *B65H 31/3027* (2013.01); *B65H 2402/344* (2013.01); *B65H 2403/512* (2013.01); *B65H 2404/2614* (2013.01); *B65H 2404/2615* (2013.01); *B65H 2404/725* (2013.01); *B65H 2701/1936* (2013.01); *B65H 2408/13* (2013.01); *B65H 2701/1912* (2013.01); *B65H 29/58* (2013.01); *B65H 2403/41* (2013.01); *G07B 1/00* (2013.01)

(56) References Cited

U.S. PATENT DOCUMENTS

| | | | | |
|---|---|---|---|---|
| 5,435,542 | A | 7/1995 | Van Pham et al. | |
| 5,897,114 | A * | 4/1999 | Arikawa et al. | 271/272 |
| 7,422,118 | B2 * | 9/2008 | Ugo et al. | 209/534 |
| 7,959,146 | B2 * | 6/2011 | Gerlier et al. | 271/3.03 |
| 8,262,076 | B2 * | 9/2012 | Wilson et al. | 271/3.01 |
| 8,376,144 | B2 * | 2/2013 | Yokokawa et al. | 209/534 |
| 8,382,103 | B2 * | 2/2013 | Cong et al. | 271/245 |

FOREIGN PATENT DOCUMENTS

| | | | |
|---|---|---|---|
| CN | 1162563 | A | 10/1997 |
| CN | 1455754 | A | 11/2003 |
| CN | 1540591 | A | 10/2004 |
| CN | 1715164 | A | 1/2006 |
| CN | 201087052 | Y | 7/2008 |
| CN | 101391712 | A | 3/2009 |
| CN | 101804923 | A | 8/2010 |
| EP | 0793198 | A2 | 9/1997 |
| EP | 1755088 | A1 | 2/2007 |
| GB | 2161145 | A * | 1/1986 |
| JP | H06274739 | A | 9/1994 |

OTHER PUBLICATIONS

Extended European Search Report for corresponding EP Application No. 12734587.4, dated Apr. 23, 2014.

Chinese Search Report received Jan. 7, 2015, for Chinese Parent Application No. 2011100049442.

* cited by examiner

SHEET MEDIUM PROCESSING DEVICE

This application is the national phase of PCT Application No. PCT/CN2012/070217 filed Jan. 11, 2012, which in turn claims the priority of Chinese patent application with application No. 201110004944.2, titled as "sheet medium processing device", and filed on Jan. 11, 2011, and all disclosed contents thereof should be incorporated herein by reference.

TECHNICAL FIELD OF THE INVENTION

The present invention relates to a sheet medium processing device.

BACKGROUND OF THE INVENTION

Common sheet mediums include train tickets, plane tickets, checks, and cashes etc., and automatic processing including stacking, distributing and recycling etc., needs to be performed for sheet mediums in more and more industries and fields with the popularization of automatic services.

For example, a cash dispenser mechanism in the financial system is able to stack, transport and recycle cashes, and a ticket issuing device in the railway system is able to stack, transport and recycle ticket paper. Traditional sheet medium processing devices have problems of complicated structures, multiple components, and high costs etc.

To solve these problems, Chinese patent application with application No. 200810027225.0 discloses a sheet medium processing device. The device comprises: a frame; an input passage mounted on the frame; a hub component, mounted on the frame, located at the exit of the input passage and configured to transport sheet mediums to a stacking and arranging assembly; the stacking and arranging assembly comprising a support plate configured to stack and receive the sheet mediums, limiting side plates set at two sides of the support plate and configured to align the sheet mediums, and a unidirectional rotational baffle set in a transport passage of the sheet mediums; a transport assembly, connected with the support plate and configured to drive the support plate to deliver the sheet mediums.

The solution has the following disadvantages: when bent, the stacked sheet mediums are aligned irregularly in the vertical direction due to the lack of a pressing device above the support plate. When the support plate carries the sheet mediums, and outputs the sheet mediums from the device, the output position is blocked easily. Therefore, the device, which requires high medium flatness, can be hardly adapted to different types of mediums.

SUMMARY OF THE INVENTION

The purpose of the present invention is to provide a sheet medium processing device with simple structure and high medium adaptability as well as functions including stacking, aligning, transporting and recycling etc.

Therefore, the present invention provides a sheet medium processing device, comprising a stacking mechanism, a first switching mechanism and a retractable paper baffle adjacent to the medium exit of the stacking mechanism, which are mounted on a frame, wherein the stacking mechanism comprises a lower ticket stacking assembly, an upper ticket stacking assembly capable of moving parallelly above the lower ticket stacking assembly and a parallel movement confining mechanism configured to limit the moving trajectory of the upper ticket stacking assembly, wherein the upper ticket stacking assembly and the lower ticket stacking assembly respectively comprise a bracket, a belt, and at least two belt pulleys mounted on the bracket to support the belt, wherein a passage for transporting mediums or a space for stacking mediums is formed between the belt of the upper ticket stacking assembly and the belt of the lower ticket stacking assembly. The upper ticket stacking assembly has a tendency of moving towards the lower ticket stacking assembly by gravity, wherein the first switching mechanism simultaneously controls the reciprocation of the paper baffle and the parallel movement of the upper ticket stacking assembly, enabling the stacking mechanism to be selectively in a transport state and a stacking state.

Further, the stacking mechanism further comprises: a first elastic element configured to enable the upper ticket stacking assembly to have the tendency of moving towards the lower ticket stacking assembly.

Further, the first switching mechanism comprises: a push plate hinged on the frame by a hinge shaft to rotate around the hinge shaft, and having an initial position and a lifting position; a cam, provided below the push plate and configured to rotate the push plate from the initial position to the lifting position; a third elastic element, configured to have the push plate being in a tendency of maintaining at the initial position, wherein the push plate has a second edge abutted against the periphery of the cam and a third edge for pushing the upper ticket stacking assembly away from the lower ticket stacking assembly when the push plate is at the lifting position.

Further, the first switching mechanism further comprises: a swinging bracket comprising a left side wall and a right side wall which are pivoted on the frame, and a connection wall extended transversely between the left side wall and the right side wall, wherein the paper baffle is provided on the connection wall; and a second elastic element configured to have the paper baffle on the swinging bracket being in a tendency of stretching out, wherein the push plate further has a first edge pushing the paper baffle on the swinging bracket to retract when the push plate is at the initial position.

Further, the paper baffle and the swinging bracket are integrated.

Further, the left side wall and the right side wall of the swinging bracket are provided with a pressing portion abutted against the first edge of the push plate.

Further, both the left side wall and the right side wall of the swinging bracket are provided with a stop portion adapted to locate a core shaft of the belt pulley of the lower ticket stacking assembly.

Further, the push plate is provided with an arc groove centered on the hinge shaft and the frame is provided with a locating pin located in the arc groove.

Further, the first switching mechanism further comprises a third driving mechanism for controlling the paper baffle independently. The third driving mechanism comprises a rack fixedly connected with the paper baffle, a gear driving the rack to move up and down, and a motor driving the gear to rotate.

Further, the lower ticket stacking assembly is hinged with the frame via a core shaft of the belt pulley adjacent to the medium exit, wherein the sheet medium processing device further comprises a second switching mechanism enabling the lower ticket stacking assembly to deflect around the core shaft.

Further, the second switching mechanism comprises: an inner gear ring fixedly connected with a bracket of the lower ticket stacking assembly and centered on the axle center of the core shaft of the belt pulley adjacent to the medium exit; a gear provided on the frame and in meshing transmission with the inner gear ring; and a driving mechanism for driving the gear to rotate.

Further, the deflection range of the lower ticket stacking assembly is between a medium discharge position and a medium recycling position. The medium recycling position is provided with a recycling box.

Further, the parallel movement confining mechanism comprises a plurality of connecting rods, wherein the plurality of connecting rods, together with the upper ticket stacking assembly and the lower ticket stacking assembly form a four-rod mechanism.

Further, the plurality of connecting rods are set in parallel, and the plurality of connecting rods, together with the upper ticket stacking assembly and the lower ticket stacking assembly form a four-rod mechanism.

In the present invention, the first switching mechanism adjusts the position relation between the upper ticket stacking assembly and the lower ticket stacking assembly of the stacking mechanism, and the position relation of the paper baffle relative to the exit or the passage for transporting mediums so as to stack, align and transport sheet mediums. When the upper ticket stacking assembly and the lower ticket stacking assembly are separated, the paper baffle is blocked at the downstream of the lower ticket stacking assembly along the medium transportation direction so that mediums transported one by one can be stacked on the lower ticket stacking assembly and aligned along the paper baffle. When the upper ticket stacking assembly is in contact with the lower ticket stacking assembly, a first belt of the upper ticket stacking assembly is tangent with a second belt of the lower ticket stacking assembly to form a sheet medium transportation passage and the paper baffle retracts at the moment.

During the transportation process, the belt of the upper ticket stacking assembly is tightly pressed against the lower ticket stacking assembly via the self-gravity of the upper ticket stacking assembly or the elasticity of the first elastic element so as to adjust and limit the vertical-direction state of multiple stacked sheet mediums, thereby achieving reliable transportation even if the sheet mediums are bent, and improving the adaptability of the device to mediums. In addition, different transportation directions can be formed by adjusting the rotating angle of the stacking mechanism through the second switching mechanism so as to transport sheet mediums to different destinations as required.

Besides purposes, features and advantages described above, the present invention also has other purposes, features and advantages. Other purposes, features and advantages of the present invention will be further described in details below as shown in drawings.

BRIEF DESCRIPTION OF THE DRAWINGS

Drawings, which form a part of the description and are provided for further understanding of the present invention, show the preferred embodiments of the present invention, and explain the principle of the present invention together with the description. In the drawings.

Explanation of reference numerals

Figure 1:
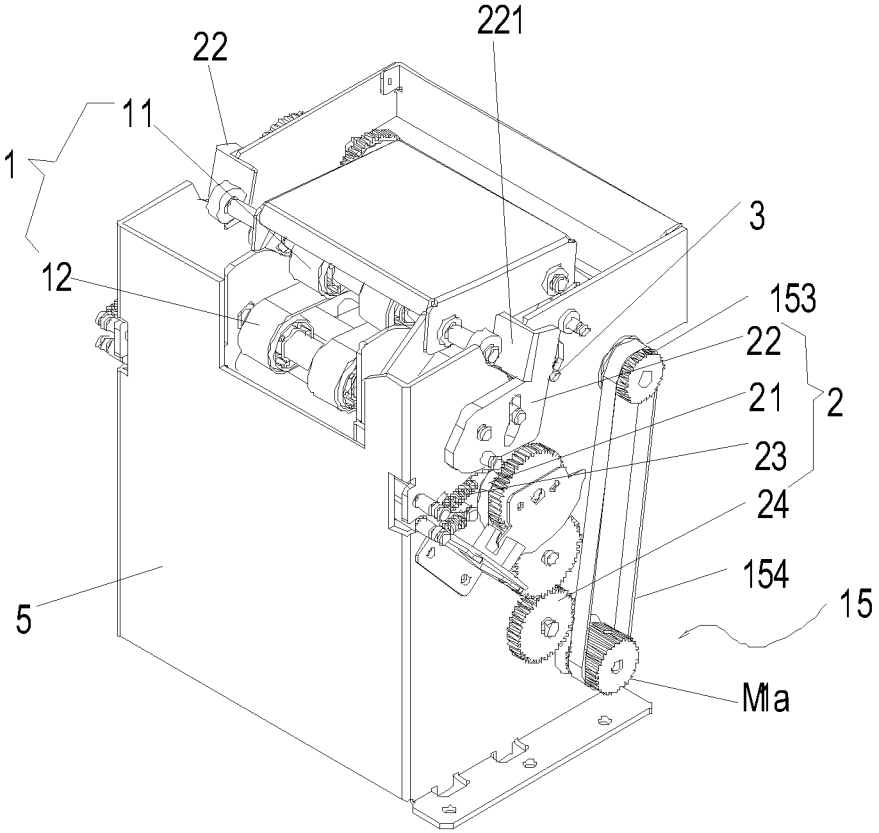
FIG. 1 is a perspective view of a sheet medium processing device according to a first embodiment of the present invention.

| | | | |
|---|---|---|---|
| 1 | stacking mechanism | 2 | first switching mechanism |
| 5 | frame | 51 | entrance |
| 53 | exit | 54 | recycling box |
| 11 | upper ticket stacking assembly | 12 | lower ticket stacking assembly |
| 14 | elastic element | 15 | first driving mechanism |
| 111 | first belt pulley | 112 | second belt pulley |
| 113 | first belt | 114 | first bracket |
| 114a | first hopper chute | 121 | third belt pulley |
| 122 | fourth belt pulley | 111a | core shaft of first belt pulley |
| 122a | core shaft of fourth belt pulley | 121a | core shaft of third belt pulley |
| 123 | second belt | 124 | second bracket |
| 124a | second hopper chute | 131 | first rotating shaft |
| 131a | first supporting rod | 131b | second supporting rod |
| 132c | rotating shaft | 132a | first connecting rod |
| 132b | second connecting rod | 151 | first gear |
| 152 | second gear | 153 | toothed belt pulley |
| 154 | toothed belt | 21 | swinging bracket |
| 22 | push plate | 23 | cam |
| 24 | second driving mechanism | 25 | second elastic element |
| 26 | third elastic element | 27 | paper baffle |
| 28 | motor gear | 29 | rack |
| 215 | left side wall | 216 | right side wall |
| 211 | hinge portion | 212 | paper baffle portion |
| 213 | pressing portion | 214 | stop portion |
| 231 | rotating shaft | 232 | first working face |
| 233 | second working face | 225 | hinge shaft |
| 224 | limiting groove | 52 | limiting shaft |
| 221 | first edge | 222 | second edge |
| 223 | third edge | M1 | motor |
| M1a | motor gear | 6 | second switching mechanism |
| 61 | inner gear | 61 | second motor |

DETAILED DESCRIPTION OF THE INVENTION

The embodiments of the present invention will be described in detail below as shown in drawings, however the present invention may be implemented by various different ways defined and covered by the claims. In the drawings, identical components are indicated by identical reference number.

FIG. 1 is a perspective view of a sheet medium processing device according to the first embodiment of the present invention. As shown in FIG. 1, the sheet medium processing device comprises a stacking mechanism 1, a first switching mechanism 2 and a frame 5, wherein the stacking mechanism 1 and the first switching mechanism 2 are mounted on the frame 5. Under the action of the first switching mechanism 2, the stacking mechanism may be provided to be in two positions including a stacking position and a transport position, wherein the stacking mechanism 1 can neatly stack mediums transported one by one when in the stacking position; the stacking mechanism 1 may transport mediums which have been stacked neatly to the downstream when in the transport position.

Figure 2:
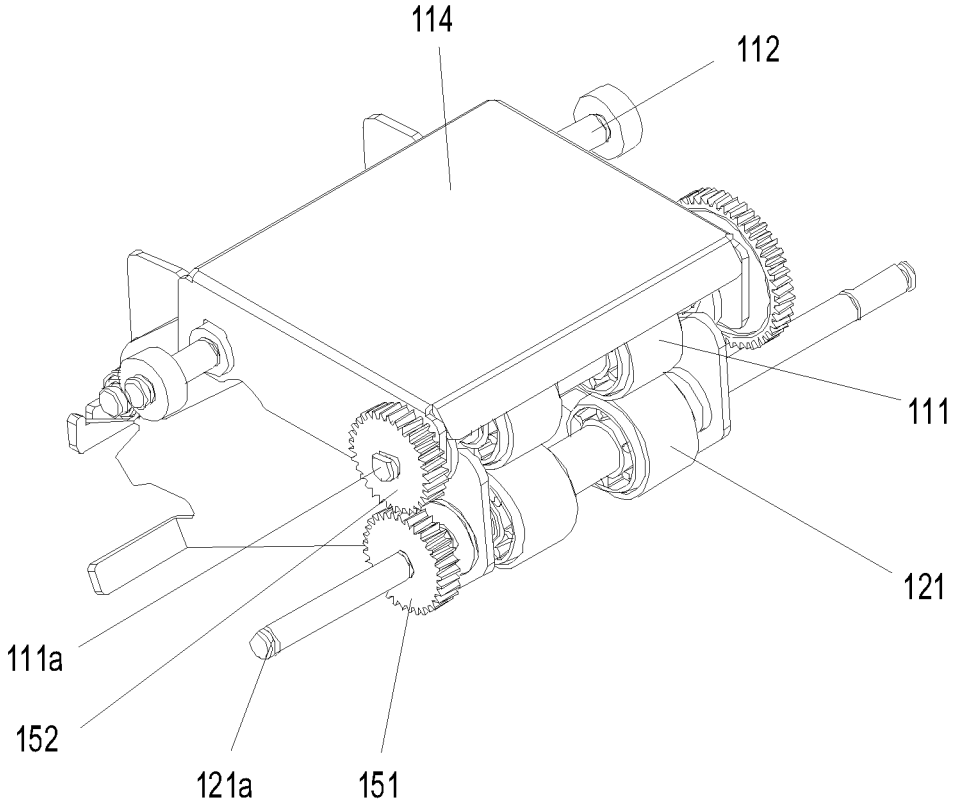
FIG. 2 is an axonometric drawing of a stacking mechanism of the sheet medium processing device shown in FIG. 1.
Figure 3:
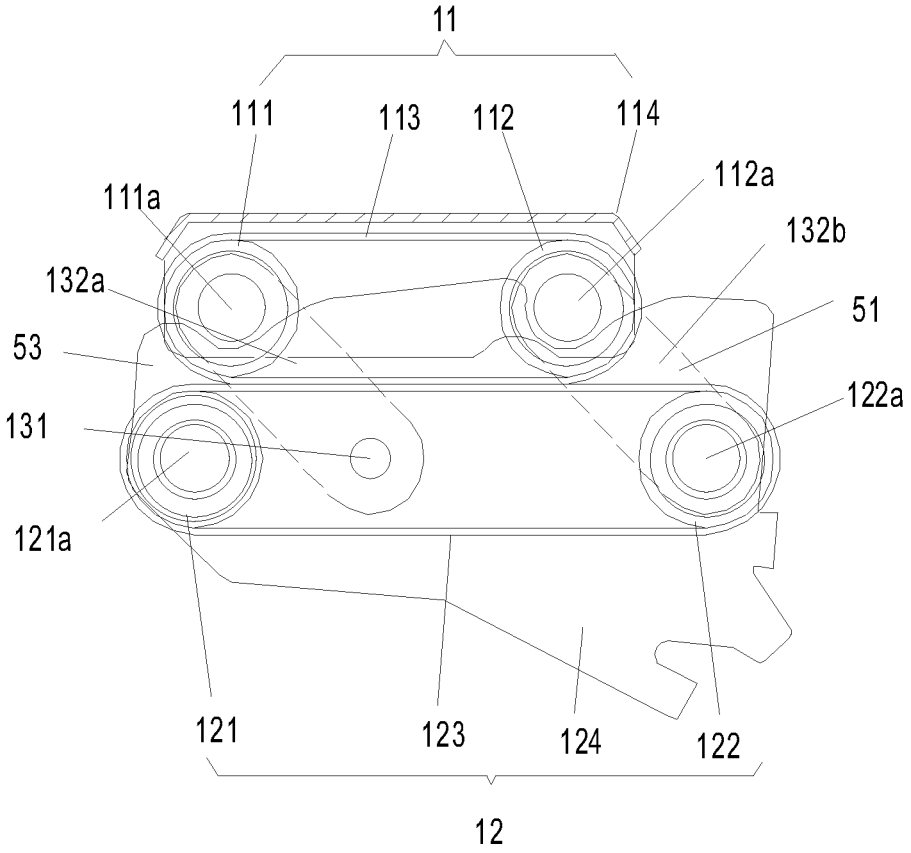
FIG. 3 is a longitudinal profile view of a stacking mechanism shown in FIG. 1.

FIG. 2 is an axonometric drawing of the stacking mechanism of the sheet medium processing device shown in FIG. 1 and FIG. 3 is a longitudinal profile view of the stacking mechanism shown in FIG. 1. An embodiment of the stacking mechanism will be explained below in combination with FIG. 1 to FIG. 3.

The stacking mechanism 1 comprises an upper ticket stacking assembly 11, a lower ticket stacking assembly 12, a parallel movement confining mechanism 13, a first elastic element 14 (shown in FIG. 4*b*) and a first driving mechanism 15.

The upper ticket stacking assembly 11 comprises a first belt pulley 111, a second belt pulley 112, a first belt 113 and a first bracket 114. The first belt pulley 111 and the second belt pulley 112 are arrayed along the medium transport direction and supported by the first bracket 114. The first belt 113 is twisted on the peripheries of the first belt pulley 111 and the second belt pulley 112 and supported by the first belt pulley 111 and the second belt pulley 112.

The lower ticket stacking assembly 12 comprises a third belt pulley 121, a fourth belt pulley 122, a second belt 123 and a second bracket 124. The second bracket 124 is fixedly connected with the frame 5. The third belt pulley 121 and the fourth belt pulley 122 are arrayed along the medium transport direction and supported by the second bracket 124. The second belt 123 is twisted on the peripheries of the third belt pulley 121 and the fourth belt pulley 122 and supported by the third belt pulley 121 and the fourth belt pulley 122.

The parallel movement confining mechanism 13 comprises a first rotating shaft 131, a first connecting rod assembly and a second connecting rod assembly (not shown in the figures). The first rotating shaft 131 is fixedly supported on the second bracket 124. The first connecting rod assembly comprises a first connecting rod 132*a* and a second connecting rod 132*b*. One end of the first connecting rod 132*a* is hinged with one end of the first rotating shaft 131 and the other end of the first connecting rod 132*a* is hinged with one end of the core shaft 111*a* of the first belt pulley 111. One end of the second connecting rod 132*b* is hinged with one end of the core shaft 122*a* of the fourth belt pulley 122 and the other end of the second connecting rod 132*b* is hinged with one end of the core shaft 112*a* of the second belt pulley 112.

The first connecting rod 132*a* and the second connecting rod 132*b* are located on the same plane. At the same time, the distance (written as L1 hereinafter) between the first rotating shaft 131 and the core shaft 111*a* of the first belt pulley 111 is equal to the distance (written as L2 hereinafter) between the core shaft 122*a* of the fourth belt pulley 122 and the core shaft 112*a* of the second belt pulley 112, and the distance (written as L3 hereinafter) between the first rotating shaft 131 and the core shaft 122*a* of the fourth belt pulley 122 is equal to the distance (written as L4 hereinafter) between the core shaft 111*a* of the first belt pulley 111 and the core shaft 112*a* of the second belt pulley 112, i.e. L1=L2, and L3=L4. The first rotating shaft 131, the core shaft 111*a* of the first belt pulley 111, the core shaft 122*a* of the fourth belt pulley 122 and the core shaft 112*a* of the second belt pulley 112 form a parallelogram.

The second connecting rod assembly comprises a third connecting rod and a fourth connecting rod (not shown in the figures), wherein one end of the third connecting rod is hinged with the other end of the rotating shaft 131, and the other end of the third connected rod is hinged with the other end of the core shaft 111*a* of the first belt pulley 111; one end of the fourth connecting rod is hinged with the other end of the core shaft 122*a* of the fourth belt pulley 122 and the other end of the fourth connecting rod is hinged with the other end of the core shaft 112*a* of the second belt pulley 112.

Thus, the upper ticket stacking assembly 11 is hinged with the lower ticket stacking assembly 12 via the first connecting rod assembly and the second connecting rod assembly and is capable of moving parallelly relative to the lower ticket stacking assembly 12 to contact or depart from the lower ticket stacking assembly 12. When the stacking mechanism is in the transport position and the upper ticket stacking assembly 11 and the lower ticket stacking assembly 12 are in contact, the first belt 113 is tangent with the second belt 123 and a passage for transporting mediums is formed therebetween. When the stacking mechanism is in the stacking position, the upper ticket stacking assembly 11 and the lower ticket stacking assembly 12 are separated, the first belt 113 and the second belt 123 are spaced with a preset distance and a space for accommodating and stacking mediums is formed therebetween.

An entrance 51 is provided at one end of the second belt pulley 112 and the fourth belt pulley 122 adjacent to the stacking mechanism 1, and an exit 53 is provided at one end of the first belt pulley 111 and the third belt pulley 121 adjacent to the stacking mechanism 1. Therefore, when the stacking mechanism 1 is in the stacking position, sheet mediums enter from the entrance 51 and are stacked between the first belt 113 and the second belt 123. When the stacking mechanism is in the transport position, the stacking mechanism 1 may discharge mediums clamped between the first belt 113 and the second belt 123 out of the sheet medium processing device via the exit 53.

One end of the first elastic element 14 is connected with the upper ticket stacking assembly 11 and the other end is connected with the lower ticket stacking assembly 12 or the frame 5. Under the action of the first elastic element 14, the upper ticket stacking assembly 11 always has a motion tendency of pressing against the lower ticket stacking assembly 12.

The first driving mechanism 15 comprises a first motor M1 and a first transmission assembly. The first transmission assembly comprises a first gear 151, a second gear 152, a toothed belt pulley 153 and a toothed belt 154 (shown in FIG. 1), wherein the first gear 151 is fixed at one end of the core shaft 121*a* of the third belt pulley 121, the toothed belt pulley 153 is fixed at the other end of the core shaft 121*a* of the third belt pulley 121, and the second gear 152 is fixed at one end of the core shaft 111*a* of the first belt pulley 111. A motor gear M1*a* of the first gear 151 is connected with the toothed belt pulley 153 via the toothed belt 154 (shown in FIG. 1), and the first gear 151 is connected with the second gear 152 is an engaging manner. Thus, when the first motor M1 drives the toothed belt pulley 153 to rotate, the first gear 151 drives the second gear 152 to rotate so as to drive the first belt 113 and the second belt 123 to move synchronously to transport sheet mediums.

Figure 4A:
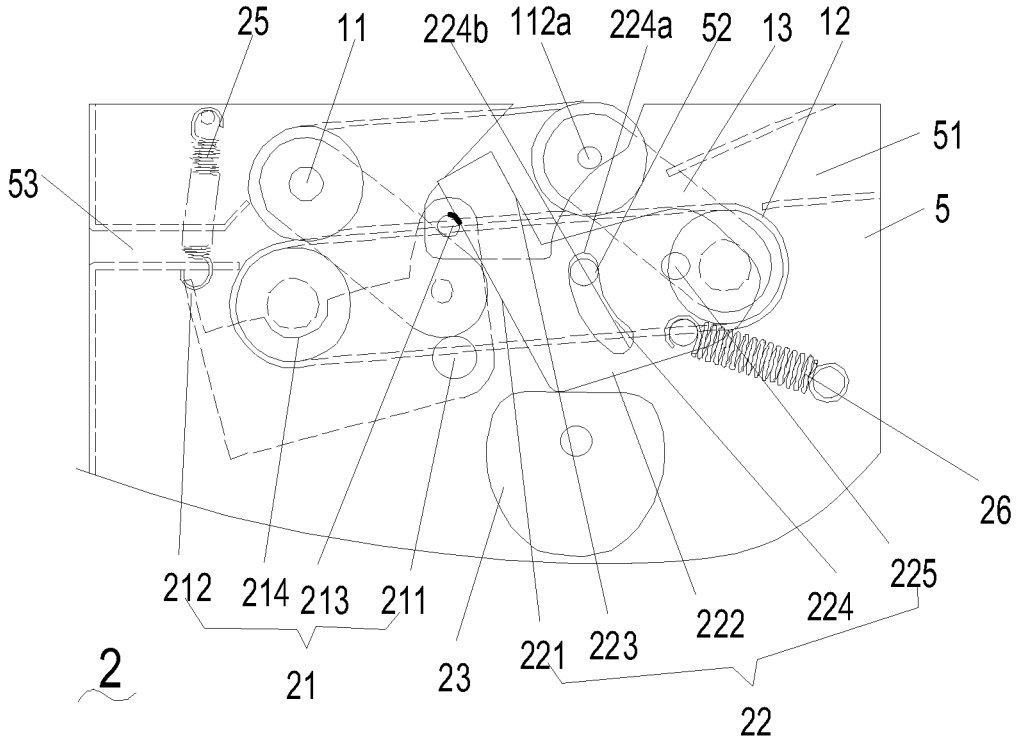
FIG. 4*a* is a lateral view of a sheet medium processing device in a transport state according to the first embodiment of the present invention.
Figure 4B:
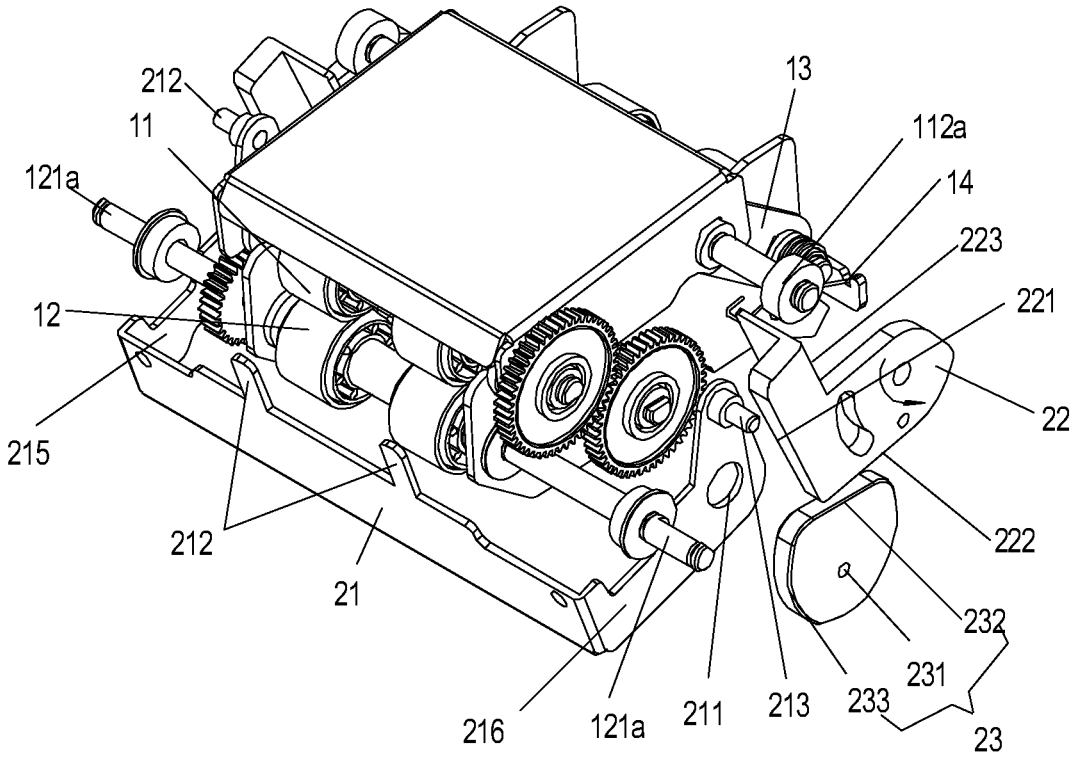
FIG. 4*b* is an axonometric drawing of a sheet medium processing device in a transport state according to the first embodiment of the present invention.

FIG. 4*a* is a lateral view of a sheet medium processing device in a transport state according to the first embodiment of the present invention and FIG. 4*b* is an axonometric drawing of a sheet medium processing device in a transport state according to the first embodiment of the present invention. An embodiment of the first switching mechanism 2 will be introduced below in combination with FIG. 1, FIG. 4*a* and FIG. 4*b*. The first switching mechanism 2 comprises a swinging bracket 21, a push plate 22, a cam 23, a second driving mechanism 24, a second elastic element 25 and a third elastic element 26.

The swinging bracket 21 is located below the lower ticket stacking assembly 12, and a left side wall 215 and a right side wall 216 of the swinging bracket 21 are hinged with the frame 5 via a hinge portion 211. A paper baffle portion 212 is provided between the left side wall 215 and the right side wall 216 of the swinging bracket 21. The paper baffle portion 212 is capable of stretching into the exit 53 or retracting from the exit 53 when the swinging bracket 21 swings. A pressing portion 213 for driving the swinging bracket 21 to rotate is provided on the left side wall 215 and/or the right side wall 216 of the swinging bracket 21. A stop portion 214 oppositely matched with the core shaft 121*a* of the third belt pulley 121 of the lower ticket stacking assembly 12 is further provided on the left side wall 215 and/or the right side wall 216 of the swinging bracket 21 to limit the rotation angle of the swinging bracket 21 towards the direction of the exit 53.

One end of the second elastic element 25 is connected with the swinging bracket 21 and the other end is connected with the frame 5. Under the elasticity of the second elastic element 25, the swinging bracket 21 always has a tendency of rotating towards the direction of the exit 53 by taking the hinge portion 211 as the circle center. Therefore, the paper baffle portion 212 always has a motion tendency of extending into the exit 53.

The cam 23 is hinged with the frame 5 via the rotating shaft 231 and can rotate around the rotating shaft 231. The periphery of the cam 23 comprises a first working face 232 and a second working face 233, wherein the first working face 232 has a first preset distance away from the rotating shaft 231, and the second working face 233 has a second preset distance away from the rotating shaft 231. The first preset distance is shorter than the second preset distance.

The push plate 22 is hinged with the frame 5 via a hinge shaft 225 and can rotate around the hinge shaft 225. A limiting groove 224 matched with a limiting shaft 52 on the frame 5 is provided on the surface of the push plate 22. The limiting groove 224 is an arc groove centered on the hinge shaft 225. The width of the limiting groove 224 is matched with the diameter of the limiting shaft 52. The length of the limiting groove 224 is greater than the diameter of the limiting shaft 52. The push plate 22 can rotate with a set angle along the length direction of the limiting groove 224.

The external profile of the push plate 22 is generally in an L shape or a T shape, and comprises a first edge 221, a second edge 222 and a third edge 223, wherein the first edge 221 is opposite to the pressing portion 213 of the swinging bracket 21 and can contact or depart from the pressing portion 213 of the swinging bracket 21; the second edge 222 is lapped with the cam 23; the third edge 223 is opposite with the core shaft 112*a* of the second belt pulley 112 of the upper ticket stacking assembly 11 and can contact or depart from the core shaft 112*a* of the second belt pulley 112.

One end of the third elastic element 26 is connected with the push plate 22 and the other end is connected with the frame 5. Under the elasticity of the third elastic element 26, the third edge 223 of the push plate 22 always has a motion tendency of departing from the core shaft 112*a* of the second belt pulley 112.

The interaction relation between the first switching mechanism and the stacking mechanism will be explained below in combination with FIG. 4*a*, FIG. 4*b*, FIG. 5*a* and FIG. 5*b*.

As shown in FIG. 4*a* and FIG. 4*b*, the second driving mechanism 24 (shown in FIG. 1) drives the cam 23 to rotate to a first set position. At this moment, the first working face 232 of the cam 23 is abutted against the second edge 222 of the push plate 22, and the push plate 22 rotates around the hinge shaft 225 to the initial position under the elasticity of the third elastic element 26. At this moment, the third edge 223 of the push plate 22 departs from the core shaft 112*a* of the second belt pulley 112 of the upper ticket stacking assembly 11, and the first edge 221 of the push plate 22 contacts the pressing portion 213 of the swinging bracket 21 to force the swinging bracket 21 rotate around the hinge portion 211 so that the paper baffle portion 212 of the swinging bracket 21 moves out of the exit 53.

At the same time, the upper ticket stacking assembly 11 presses against the lower ticket stacking assembly 12 under the action of the first elastic element 14. Supported and limited by the parallel movement confining mechanism, the position of the upper ticket stacking assembly 11 relative to the lower ticket stacking assembly 12 is stable. At this moment, the first belt 113 of the upper ticket stacking assembly 11 is tangent with the second belt 123 of the lower ticket stacking assembly 12, and a passage for transporting mediums is formed therebetween. Therefore, the stacking mechanism 1 can be driven to the transport position by correlative movements of the components of the first switching mechanism 2.

In other variant embodiments, the paper baffle portion 212 may be shaped independently, i.e. the paper baffle portion and the swinging bracket 21 are two components.

Figure 5A:
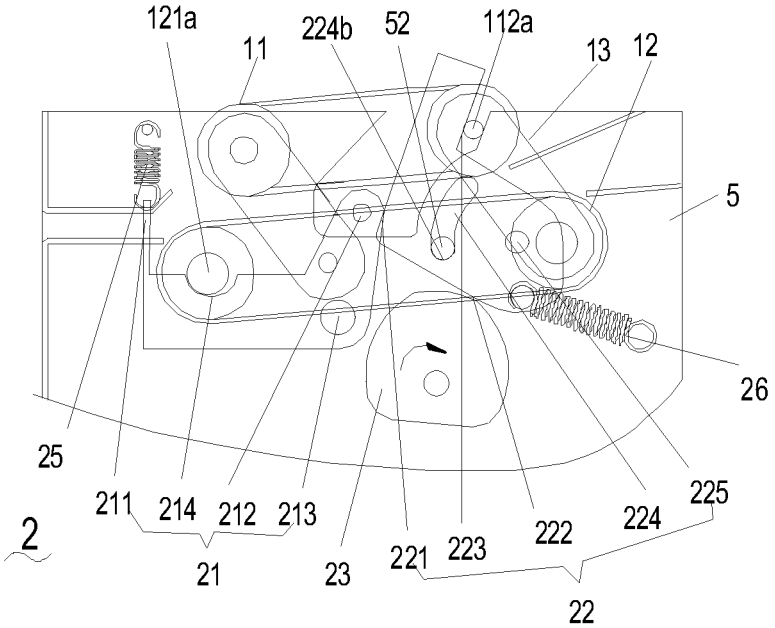
FIG. 5*a* is a lateral view of a sheet medium processing device in a stacking state according to the first embodiment of the present invention.
Figure 5B:
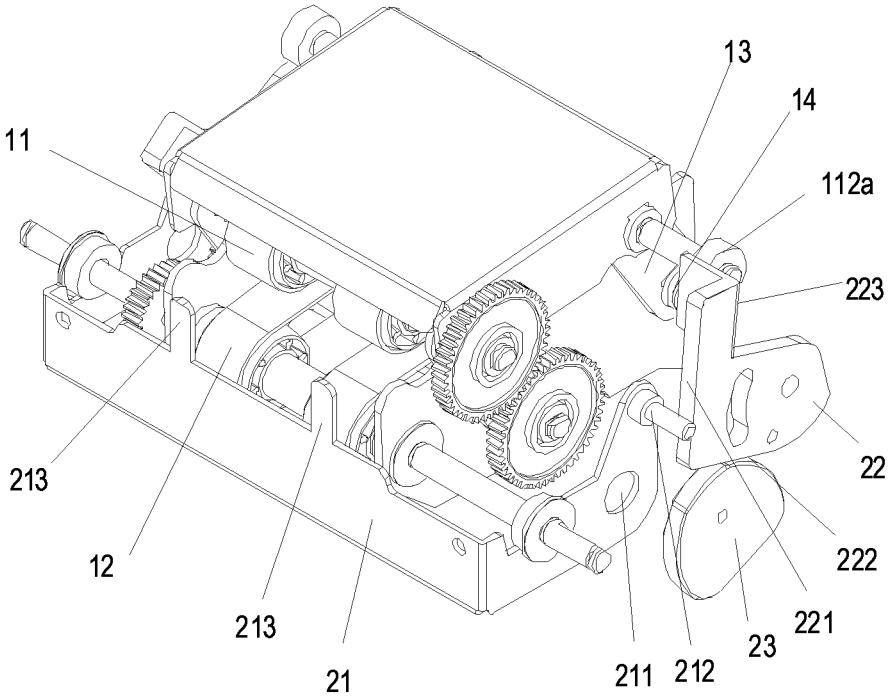
FIG. 5*b* is an axonometric drawing of a sheet medium processing device in a stacking state according to the first embodiment of the present invention.

As shown in FIG. 5*a* and FIG. 5*b*, the second driving mechanism 24 drives the cam 23 to rotate to a second set position. At this moment, the second working face of the cam 23 is abutted against the second edge 222 of the push plate 22. The second working face of the cam 23 pushes the push plate 22 to overcome the elasticity of the third elastic element 26 and rotate around the hinge shaft 225 to a lifting position. At this moment, the third edge 223 of the push plate 22 is abutted against the shaft end of the core shaft 112*a* of the second belt pulley 112 of the upper ticket stacking assembly 11 and pushes the upper ticket stacking assembly 11 to move parallelly relative to the lower ticket stacking assembly 12 so that the first belt 113 of the upper ticket stacking assembly 11 has a preset distance away from the second belt 123 of the lower ticket stacking assembly 12, and a space for accommodating and stacking mediums is formed therebetween.

At the same time, since the first edge 221 of the push plate 22 is separated from the pressing portion 213 of the swinging bracket 21, the swinging bracket 21 rotates around the hinge portion 211 under the elasticity of the second elastic element 25. The stop portion 214 of the swinging bracket 21 is in contact and matched with the core shaft 121*a* of the third belt pulley 121 of the lower ticket stacking assembly 12. At this moment, the paper baffle portion 212 of the swinging bracket 21 extends into the exit 53 and is located at the downstream of the stacking mechanism 1. Therefore, the stacking mechanism 1 can be driven to the stacking position by correlative movements of all components of the first switching mechanism 2.

A working process of the sheet medium processing device provided by the present invention is introduced below.

When mediums need to be stacked, a control device (not shown in the figures) of the sheet medium processing device controls the cam 23 of the first switching mechanism 2 to rotate to the second set position. At this moment, the cam 23 rotates to drive the push plate 22 and the swinging bracket 21 to rotate, so that there is a preset distance between the first belt 113 of the upper ticket stacking assembly 11 and the second belt 123 of the lower ticket stacking assembly 12 and a space for accommodating and stacking the mediums is formed therebetween. The first belt 113 and the second belt 123 are in a static state, and the paper baffle portion 212 of the swinging bracket 21 extends into the exit 53.

The sheet mediums enter the space between the upper ticket stacking assembly 11 and the lower ticket stacking assembly 12 one by one. Since the paper baffle portion 212 of the swinging bracket 21 is located at the downstreams of the upper ticket stacking assembly 11 and the lower ticket stacking assembly 12, the sheet mediums are blocked on the surface of the lower ticket stacking assembly 12 by the paper baffle portion 212 and aligned along the paper baffle portion 212.

After a certain amount of sheet mediums are stacked, the sheet mediums stored on the surface of the lower ticket stacking assembly 12 temporarily need to be sent out once. The control device of the sheet medium processing device controls the second driving mechanism 24 to drive the cam 23 to rotate to the first set position. At this moment, the cam 23 rotates to drive the push plate 22 and the swinging bracket 21 to move. Under the action of the first elastic element 14, the upper ticket stacking assembly 11 presses towards the lower ticket stacking assembly 12 to clamp the stacked mediums between the first belt 113 of the upper ticket stacking assembly 11 and the second belt 123 of the lower ticket stacking assembly 12. Subsequently, the first driving mechanism 15 drives the first belt 113 and the second belt 123 to move synchronously to send out the neatly-stacked sheet mediums.

The sheet mediums stacked by the sheet medium processing device provided by the present invention are located between the first belt 113 and the second belt 123. Therefore, even if the sheet mediums are bent, the vertical-direction state of multiple stacked sheet mediums can be adjusted and limited by utilizing the elasticity of the belts, thereby ensuring reliable transportation.

Figure 6:
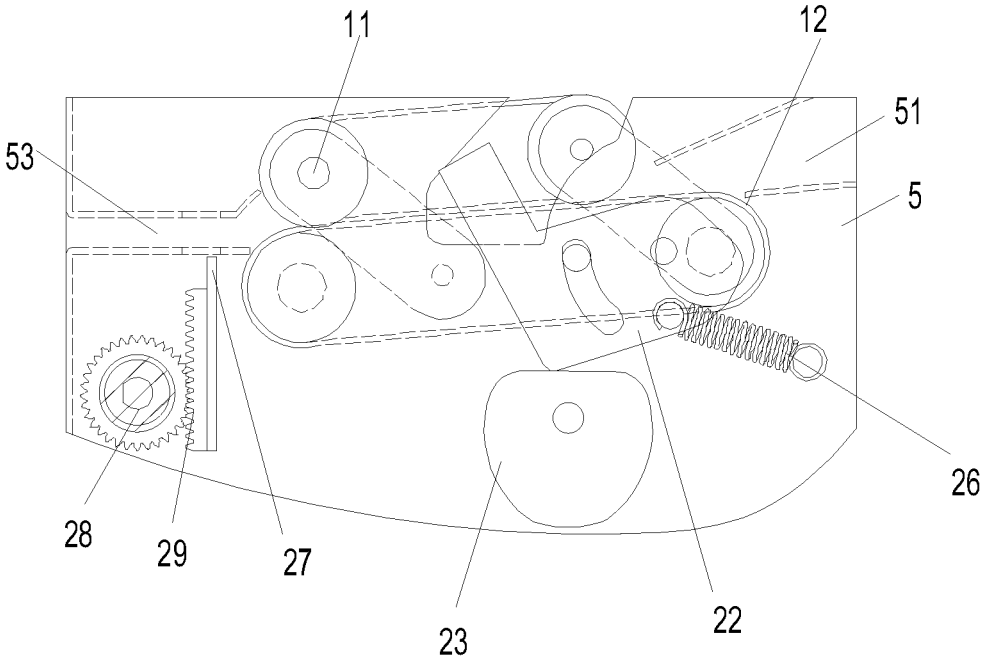
FIG. 6 is a lateral view of a sheet medium processing device in a transport state according to a second embodiment of the present invention.

FIG. 6 is a lateral view of a sheet medium processing device in a transport state according to the second embodiment of the present invention. As shown in the figure, the difference of the present embodiment compared with the previous embodiment is that the first switching mechanism 2 in the present embodiment does not need to provide the swinging bracket 21 and the second elastic element 25. The movements of a paper baffle 27 and the push plate 22 are controlled by independent driving mechanisms, respectively.

As shown in FIG. 6, the paper baffle 27 is provided vertical to the passage for transporting mediums, located at the exit 53 of the stacking mechanism 11 along the medium transport direction and configured to stop mediums from moving towards the exit 53 when the stacking mechanism 1 stacks the mediums. The first switching mechanism 2 further comprises a third driving mechanism, wherein the third driving mechanism comprises a third motor (not shown in the figure), a motor gear 28 and a rack 29. The motor gear 28 is fixedly connected with a driving shaft of the third motor. The rack 29 is fixedly connected with the paper baffle 27, and connected with the motor gear 28 in an engaging manner. Therefore, the paper baffle 27 and the rack 29 move synchronously when the rack 29 moves.

When the stacking mechanism 1 is in the stacking position, the motor gear 28 of the third motor rotates positively to drive the rack 29 engaged with the motor gear 28 to move upwards so that the paper baffle 27 moves upwards to block the downstream of the stacked mediums. When the stacking mechanism 1 is in the transport position, the third motor drives the motor gear 28 to rotate negatively to drive the rack 29 engaged with the motor gear to move downwards so that the paper baffle 27 moves downwards so the mediums can be sent out from the exit 53.

Figure 7:
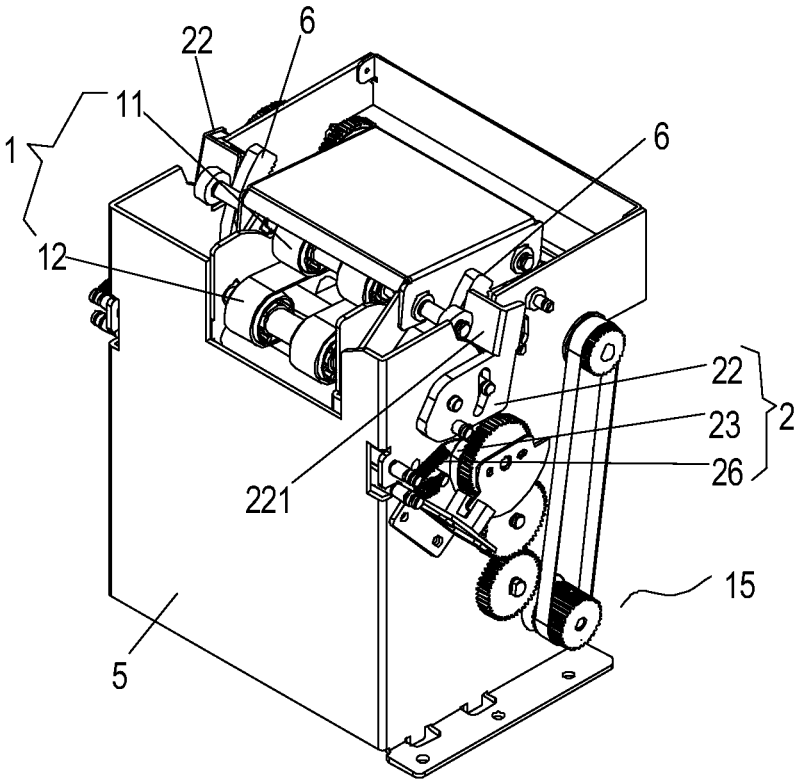
FIG. 7 is a perspective view of a sheet medium processing device according to a third embodiment of the present invention.
Figure 8:
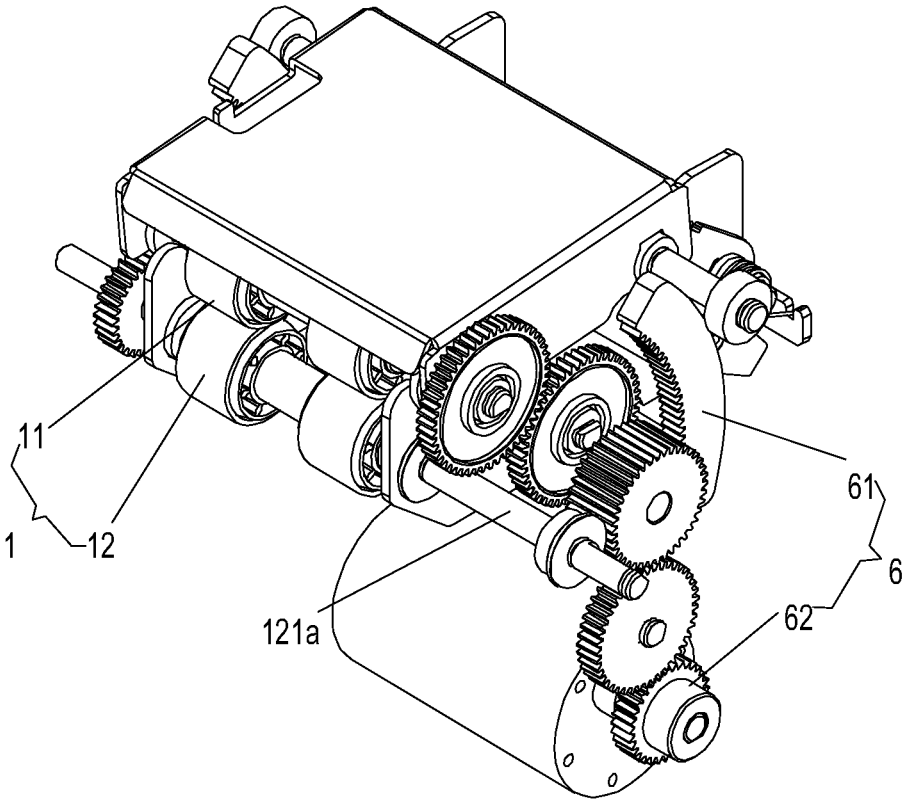
FIG. 8 is a schematic view of a partial structure of the sheet medium processing device shown in FIG. 7.

FIG. 7 is a perspective view of a sheet medium processing device according to the third embodiment of the present invention and FIG. 8 is a schematic view of a partial structure of the sheet medium processing device shown in FIG. 7. As shown in FIG. 7 and FIG. 8, the difference of the present embodiment compared with the first embodiment is that the stacking mechanism 1 is hinged with the frame 5 through the core shaft 121*a* of the third belt pulley 121 and capable of rotating around the core shaft 121*a* of the third belt pulley 121. A recycling box 54 (shown in FIG. 9) is provided below the entrance 51 to recycle invalidated or forgotten sheet mediums. The sheet medium processing device further comprises a second switching mechanism 6. The second switching mechanism 6 is configured to realizing switching of the output direction of the stacking mechanism 1 between a paper discharge direction and a recycling direction, wherein the paper discharge direction means that the stacking mechanism 1 pushes stacked mediums towards the location where the exit 53 locates, and the recycling direction means that the stacking mechanism 1 discharges the stacked mediums to the location where the recycling box 54 (shown in FIG. 9) locates.

Specifically, the stacking mechanism 1 is hinged with the frame 5 via the core shaft 121*a* of the third belt pulley 121 of the lower ticket stacking assembly 12. The second switching mechanism 6 comprises an inner gear 61 and a second motor 62. The inner gear 61 is located at the outer side of the passage for transporting mediums and fixedly connected with the second bracket 124 of the lower ticket stacking assembly 12. The circle center of the inner gear 61 is coaxial with the core shaft 121*a* of the third belt pulley of the lower ticket stacking assembly 12. The second motor 62 is provided on the frame 5. The motor gear of the second motor 62 is in transmission connection with the inner gear 61 via a group of transition gears.

Since the inner gear 61 fixedly connected with the lower ticket stacking assembly 12 is in transmission connection with the second motor 62 via a group of transition gears, when the second motor 62 drives the inner gear 61 to rotate around the center of the second motor with a set angle, the lower ticket stacking assembly 12 can rotate with a set angle by taking the core shaft 121*a* of the third belt pulley are the circle center, and when the second motor 62 stops rotating and is self-locked, the position of the lower ticket stacking assembly 12 can be kept unchanged. Thus, the relative positions of the stacking mechanism 1 and the frame 5 can be changed thought the second switching mechanism 6 so as to set the discharge direction of the stacked mediums as required.

A working process for realizing recycling and processing of the sheet medium processing device according to the present embodiment will be explained below in combination with FIG. 9 and FIG. 10.

Figure 9:
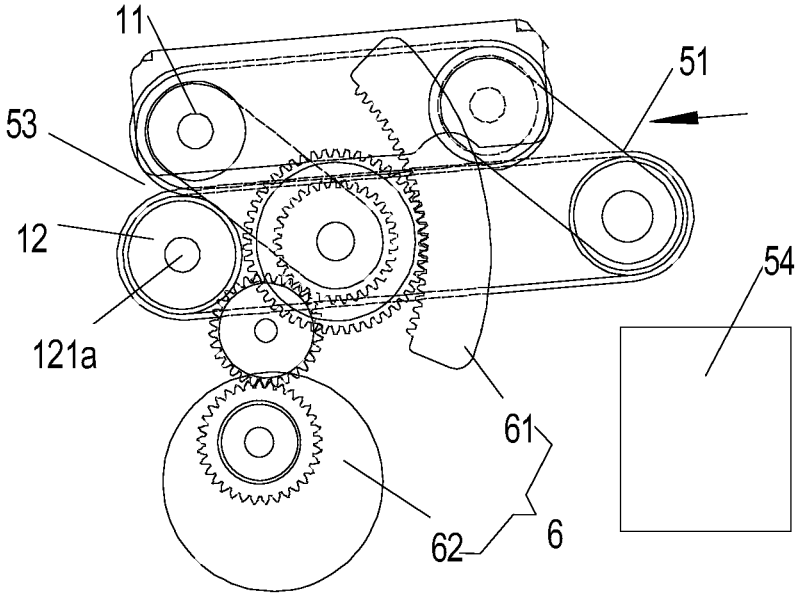
FIG. 9 is a schematic view of a sheet medium processing device in a transport state according to the third embodiment of the present invention.

As shown in FIG. 9, after sheet mediums are stacked, the stacking mechanism 1 switches from the stacking position to the transport position. In the transport position, the stacking mechanism 1 discharges the stacked mediums along the paper discharge direction first. At this moment, the second motor 62 does not rotate and is in a self-locked state. Therefore, the positions of the inner gear 61 and the lower ticket stacking assembly 12 fixedly connected with the inner gear 61 are fixed. At this moment, the stacking mechanism 1 can discharge the stacked mediums towards the location where the exit 53 locates. If the mediums are not taken away after a set period of time, the first driving mechanism 15 of the stacking mechanism 1 drives the first belt 113 and the second belt 123 to move reversely to recycle the mediums into the stacking mechanism 1.

Figure 10:
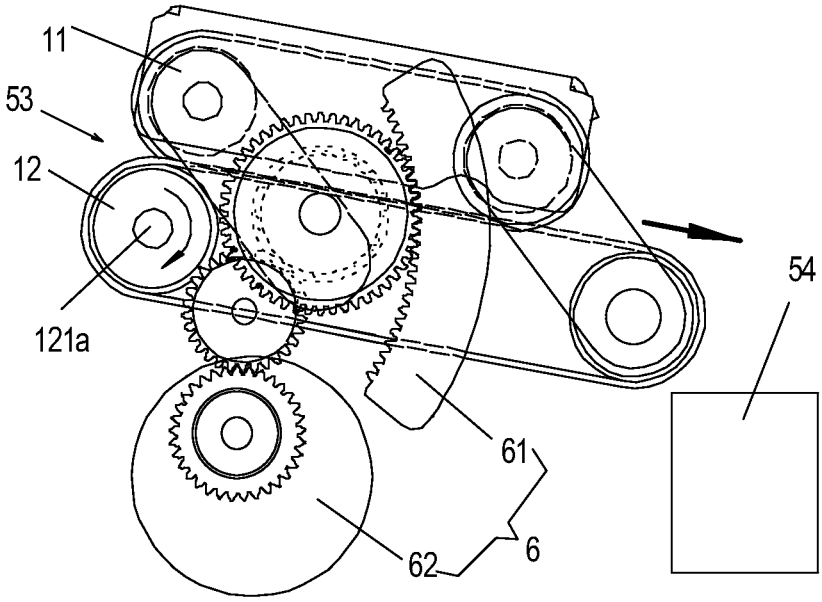
FIG. 10 is a schematic view of a sheet medium processing device in a recycling state according to the third embodiment of the present invention.

As shown in FIG. 10, after the stacking mechanism 1 recycles the mediums into the stacking mechanism 1, the second motor 62 drives the inner gear 61 to rotate with a set angle in a preset direction to drive the stacking mechanism 1 to rotate synchronously with the inner gear 61 with a set angle so that the stacking mechanism 1 can discharge the stacked mediums towards the location where the recycling box 54 locates. Subsequently, the first driving mechanism 15 drives the first belt 113 and the second belt 123 to rotate reversely to send the mediums into the recycling box 54.

It needs to be shown that the rotation angle of the stacking mechanism 1 may be set through the control of the second motor 62. The rotation angle of the stacking mechanism 1 can be adjusted so that the stacking mechanism 1 can transport mediums along different directions to transport the sheet mediums to different destinations such as the recycling box or an invalidated ticket box etc. as required.

In addition, the first belt 113 and the second belt 123 may be two or more narrow belts in parallel. At this moment, the paper baffle 27 may be located in a gap between the two narrow belts and extend into the space for stacking mediums between the first belt 113 and the second belt 123.

In addition, the parallel movement confining mechanism is not limited to a parallel four-rod mechanism as long as the parallel movement confining mechanism is able to limit the upper ticket stacking mechanism 11 to move parallelly from the lower ticket stacking mechanism 12.

Figure 11:
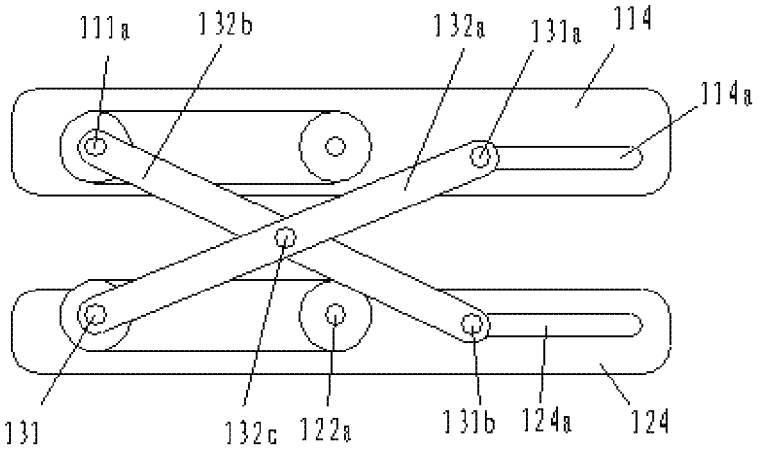
FIG. 11 is a schematic view of a partial structure of a sheet medium processing device according to a fourth embodiment of the present invention.

FIG. 11 is a schematic view of a partial structure of a sheet medium processing device according to the fourth embodiment of the present invention. As shown in FIG. 11, the difference of the present embodiment compared with other embodiments is that, in the parallel movement confining mechanism, the first connecting rod 132*a* and the second connecting rod 132*b* are hinged by a rotating shaft 132*c*. One end of the first connecting rod 132*a* is hinged with one end of the first rotating shaft 131, and the other end of the first connecting rod 132*a* is fixedly provided with a first supporting rod 131*a*. The first supporting rod 131*a* can slide along the length direction of a first hopper chute 114*a*. One end of the second connecting rod 132*b* is hinged with one end of the core shaft 111*a* of the first belt pulley 111 and the other end of the second connecting rod is fixedly provided with a second supporting rod 131*b*. The second supporting rod 131*b* can slide along the length direction of a second hopper chute 124*b*.

When the first connecting rod 132*a* or the second connecting rod 132*b* are lifted around the hinge point, the parallel movement confining mechanism pushes the upper ticket stacking assembly 11 to move parallelly relative to the lower ticket stacking assembly 12 so that the upper ticket stacking assembly 11 and the lower ticket stacking assembly 12 are separated and a space for stacking mediums is formed therebetween.

When the first connecting rod 132*a* or the second connecting rod 132*b* descends, the first supporting rod 131*a* moves along the length direction of the first hopper chute 114*a* and the second supporting rod 131*b* moves along the length direction of the second hopper chute 124*a*, the upper ticket stacking assembly 11 contacts the lower ticket stacking assembly 12 to form a passage for transporting mediums therebetween under the action of the self-gravity of the upper ticket stacking assembly 11 or an external force. In the present embodiment, the first switching mechanism 2 may be a gear rack driving mechanism or a cam driving mechanism.

In other embodiments, the parallel movement confining mechanism may be a guide mechanism such as a guide groove or a guide pillar etc., so as to limit the moving trajectory of the upward parallel movement of the upper stacking assembly 11 relative to the lower ticket stacking assembly 12.

Above contents only describe the preferred embodiments of the present invention and are not intended to limit the present invention; for one skilled in the art, the present invention may have various modifications and changes. Any modifications, equivalent replacements and improvements made within the spirit and principle of the present invention should be included within the protection scope of the present invention.

The invention claimed is:

1. A sheet medium processing device, comprising a stacking mechanism, a first switching mechanism and a retractable paper baffle adjacent to a medium exit of the stacking mechanism, which are mounted on a frame, the retractable paper baffle retractable with respect to the medium exit, wherein the stacking mechanism comprises a lower ticket stacking assembly, an upper ticket stacking assembly capable of moving parallel above the lower ticket stacking assembly and a parallel movement confining mechanism configured to limit the moving trajectory of the upper ticket stacking assembly;

wherein the upper ticket stacking assembly and the lower ticket stacking assembly respectively comprise a bracket, a belt, and at least two belt pulleys mounted on the bracket to support the belt;

wherein a passage for transporting mediums or a space for stacking mediums is formed between the belt of the upper ticket stacking assembly and the belt of the lower ticket stacking assembly;

wherein the upper ticket stacking assembly has a tendency of moving towards the lower ticket stacking assembly by gravity;

wherein the first switching mechanism simultaneously controls reciprocation of the paper baffle and parallel movement of the upper ticket stacking assembly, enabling the stacking mechanism to be selectively in a transport state and a stacking state wherein the first switching mechanism comprises:

a push plate hinged on the frame by a hinge shaft to rotate around the hinge shaft, and having an initial position and a lifting position;

a cam, provided below the push plate and configured to rotate the push plate from the initial position to the lifting position;

a third elastic element, configured to have the push plate being in a tendency of maintaining at the initial position;

a swinging bracket comprising a left side wall and a right side wall which are pivoted on the frame, and a connection wall extended transversely between the left side wall and the right side wall, wherein the paper baffle is provided on the connection wall; and a second elastic element configured to have the paper baffle on the swinging bracket being in a tendency of stretching out, wherein the paper baffle is stretched out with respect to the medium exit;

wherein the push plate has a first edge pushing the paper baffle on the swinging bracket to retract when the push plate is at the initial position, a second edge abutted against the periphery of the cam, and a third edge for pushing the upper ticket stacking assembly away from the lower ticket stacking assembly when the push plate is at the lifting position.

2. The sheet medium processing device according to claim 1, wherein the stacking mechanism further comprises a first elastic element configured to enable the upper ticket stacking assembly to have the tendency of moving towards the lower ticket stacking assembly.

3. The sheet medium processing device according to claim 1, wherein the paper baffle and the swinging bracket are integrated.

4. The sheet medium processing device according to claim 1, wherein the left side wall and the right side wall of the swinging bracket are provided with a pressing portion abutted against the first edge of the push plate.

5. The sheet medium processing device according to claim 1, wherein both the left side wall and the right side wall of the swinging bracket are provided with a stop portion adapted to locate a core shaft of the belt pulley of the lower ticket stacking assembly.

6. The sheet medium processing device according to claim 1, wherein the push plate is provided with an arc groove centered on the hinge shaft and the frame is provided with a locating pin located in the arc groove.

7. The sheet medium processing device according to claim 1, wherein the lower ticket stacking assembly is hinged with the frame via a core shaft of the belt pulley adjacent to the medium exit, wherein the sheet medium processing device further comprises a second switching mechanism enabling the lower ticket stacking assembly to deflect around the core shaft.

8. The sheet medium processing device according to claim 7, wherein the second switching mechanism comprises:

an inner gear ring fixedly connected with a bracket of the lower ticket stacking assembly and centered on the axle center of the core shaft of the belt pulley adjacent to the medium exit;

a gear provided on the frame and in meshing transmission with the inner gear ring; and a driving mechanism for driving the gear to rotate.

9. The sheet medium processing device according to claim 7, wherein a deflection range of the lower ticket stacking assembly is between a medium discharge position and a medium recycling position, and wherein the medium recycling position is provided with a recycling box.

10. The sheet medium processing device according to claim 1, wherein the parallel movement confining mechanism comprises a plurality of connecting rods, wherein the plurality of connecting rods, together with the upper ticket stacking assembly and the lower ticket stacking assembly form a four-rod mechanism.

11. The sheet medium device according to claim 10, wherein the plurality of connecting rods are set in parallel, and the plurality of connecting rods, together with the upper ticket stacking assembly and the lower ticket stacking assembly form a four-rod mechanism.

* * * * *